United States Patent [19]

Muranoi et al.

[11] Patent Number: 4,947,011

[45] Date of Patent: Aug. 7, 1990

[54] ILLUMINATED SWITCH DEVICE

[75] Inventors: Tsuyoshi Muranoi; Akinori Ito, both of Furukawa, Japan

[73] Assignee: Alps Electric Co., Ltd., Tokyo, Japan

[21] Appl. No.: 398,107

[22] Filed: Aug. 24, 1989

[30] Foreign Application Priority Data

Dec. 6, 1988 [JP] Japan ..... 63-158047[U]

[51] Int. Cl.[5] ..... H01H 9/00

[52] U.S. Cl. ..... 200/314; 200/313; 200/310; 200/311

[58] Field of Search ..... 200/310, 311, 313, 314

[56] References Cited

U.S. PATENT DOCUMENTS

| | | | |
|---|---|---|---|
| 4,163,883 | 8/1979 | Boulanger | 200/314 |
| 4,259,559 | 3/1981 | Kondo et al. | 200/314 |
| 4,277,665 | 7/1981 | Kondo et al. | 200/314 |
| 4,385,221 | 5/1983 | Dörfk | 200/314 |
| 4,395,611 | 7/1983 | Kondo et al. | 200/314 |
| 4,771,725 | 9/1988 | Miyaguchi et al. | 200/314 |
| 4,778,966 | 10/1988 | Obata et al. | 200/314 |

*Primary Examiner*—Henry J. Recla
*Assistant Examiner*—Keith Kopferschmid
*Attorney, Agent, or Firm*—Guy W. Shoup

[57] ABSTRACT

An illuminated switch device including a single light source and an operating knob provided with an indicator adapted to be illuminated in different selective colors by a light from the light source. The switch device further includes a light transmissive member fixed to the operating knob, a case for slidably mounting the operating knob therein which case has first and second openings at positions perpendicular to each other, a shutter rotatably supported to the case and adapted to selectively open and close the first and second openings by reciprocation of the operating knob, and transparent color filters having a light transmissivity provided in light paths passing through the first and second openings.

1 Claim, 3 Drawing Sheets

ILLUMINATED SWITCH DEVICE

BACKGROUND OF THE INVENTION

The present invention relates to an illuminated switch device, and more particularly to an illuminated switch device capable of changing an illumination color of an indicator in association with the operation of a knob.

This kind of illuminated switch device is widely utilized as an on-vehicle switch. For example, at the same time a vehicle light is turned on, a light source of the switch is designed to be turned on to illuminate the indicator of the knob, so that an operator can easily recognize the indication on the knob even in the night or in the dark such as a tunnel.

FIGS. 5A and 5B show a conventional illuminated switch device proposed by the same applicant, which device is disclosed in Japanese Patent Publication No. 57-35529. Referring to the drawings, reference numeral 1 designates a push-button switch mounted to a metal mounting frame 2. The push-button switch 1 is operated by an operating rod 3. A return coil spring 4 is provided around the operating rod 3 so as to return the push-button switch 1 to a normal or rest position. Reference numeral 5 designates a knob holder formed of synthetic resin. The knob holder 5 has a front opening portion to which a knob 6 is fixed. The knob 6 is formed of a light transmissive resin having an appropriate color. Reference number 7 designates a slider formed of synthetic resin. The slider 7 is integrally formed with an operating arm **7*a* and a forked tongue 7*b*. The knob holder 5 is mounted to the front end portion of the slider 7. The slider 7 is slidably mounted in a case 8 formed of synthetic resin. Reference numeral 9 designates a rotatable member having a pair of supporting shafts 9*a*, a forked tongue 9*b* and a planar filter 9*c* formed of a translucent resin. The rotatable member 9 is rotatably supported through the supporting shafts 9*a* to the case 8. As shown in FIG. 5A under the undepressed condition of the knob 6, the filter 9*c* is opposed to the tongue 7*b* of the slider 7. Reference numeral 11 designates a lamp cover for supporting a lamp 12 as a light source. A light transmissive member 10 formed of a light transmissive resin is mounted in the lamp cover 11. A coil spring 13 is interposed between the operating arm 7*a* and the case 8. The knob holder 5, the knob 6 and the slider 7** constitute a push button.

In operation, the lamp 12 is normally maintained in an on-state irrespective of the position of the knob 6. When the knob 6 is in the undepressed position as shown in FIG. 5A, the light from the lamp 12 is transmitted through both the filter **9*c* and the knob 6. Accordingly, a quantity of the light is remarkably reduced to dimly illuminate the indicator on the knob 6. On the other hand, when the knob 6 is depressed to displace the slider 7 in a direction of an arrow Y shown in FIG. 5A, the operating rod 3 of the push-button switch 1 is urged by the operating arm 7*a* of the slider 7 against the biasing force of the coil spring 4. As a result, the push-button switch 1 is turned on. At the same time, the filter 9*c* of the rotatable member 9 is urged by the tongue 7*b* of the slider 7 to be rotated as shown in FIG. 5B. As a result, the filter 9*c* is located outside the light path, while the forked tongue 9*b* is located in the light path. Under the condition, the light from the lamp 12 is allowed to pass through the vacancy of the forked tongues 7*b* and 9*b*, and is transmitted through the knob 6 only. Therefore, the quantity of the light is increased more than that in the condition shown in FIG. 5A, and the indicator on the knob 6** is brightly illuminated.

Thus, the on/off state of the push-button switch 1 can be recognized by the difference in brightness of the illuminated indicator due to a change in the quantity of the light from the lamp 12. Alternatively, in the case that the knob 6 and the filter **9*c*** are colored, the on/off state can be recognized by the difference in tone of the illuminated indicator.

However, the above-mentioned prior art switch device has the following problem. First, as the rotatable member 9 is rotated at 90 degrees by the reciprocation of the slider 7 to thereby selectively locate the filter **9*c* outside or inside the light path, the rotatable member 9 must be provided in a narrow space within a moving area of the slider 7. Accordingly, the assembly of the rotatable member 9 with the slider 7 is rendered troublesome. Further, there is a possibility that a rotational angle of the rotatable member 9 under the undepressed or depressed condition of the knob 6 will be fluctuated because of a variation in the dimensional accuracy of the parts such as the filter 9*c*. For example, when the knob 6 is in the depressed position, there is a possibility that the filter 9*c*** will be partially located in the light path, causing ununiformity of the illumination of the indicator.

SUMMARY OF THE INVENTION

It is an object of the present invention to provide an illuminated switch device which may be easily assembled.

It is another object of the present invention to provide an illuminated switch device which may eliminate the ununiformity of the illumination color.

According to the present invention, there is provided in an illuminated switch device including a single light source and an operating knob provided with an indicator adapted to be illuminated in different selective colors by a light from said light source; the improvement comprising a light transmissive member fixed to said operating knob, a case for slidably mounting said operating knob therein, said case having first and second openings at positions perpendicular to each other, a shutter rotatably supported to said case and adapted to selectively open and close said first and second openings by reciprocation of said operating knob, and transparent color filters having a light transmissivity provided in light paths passing through said first and second openings.

As mentioned above, the shutter is provided at a position between the light source and the first opening and between the light source and the second opening, and the shutter is rotatable by the reciprocation of the operating knob. That is, either of the light path from the light source through the first opening to the indicator or the light path from the light source through the second opening to the indicator is reliably cut by the shutter. Accordingly, even when there is a slight variation in the rotational angle of the shutter under the operative or inoperative condition of the operating knob, the transmitted lights from the filters provided at the first and second openings are prevented from interfering with each other, thus preventing the ununiformity of the illumination color of the light passing through the indicator. Furthermore, as the locus of the rotation of the shutter can be set outside the moving area of the operating knob, the assembly of the shutter to be rotatably supported to the case is improved.

Other objects and features of the invention will be more fully understood from the following detailed description and appended claims when taken with the accompanying drawings.

DETAILED DESCRIPTION OF THE PREFERRED EMBODIMENT

Figure 1:
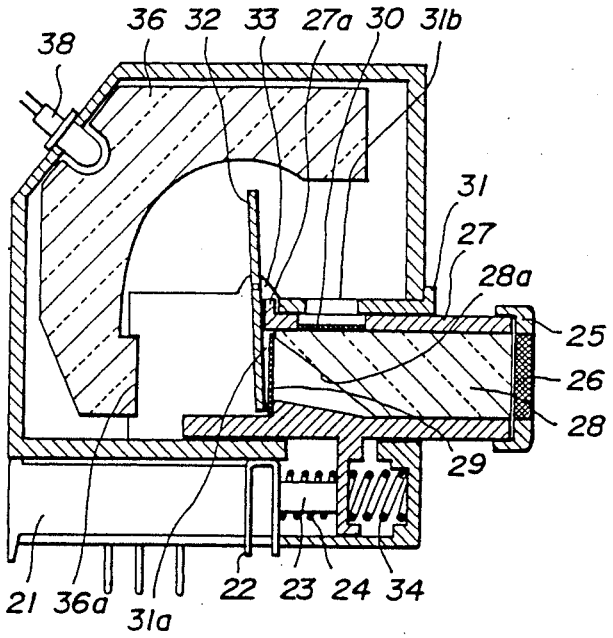
FIG. 1 is a sectional view of a preferred embodiment of the illuminated switch device according to the present invention.

Referring to FIGS. 1 to 4 which show a preferred embodiment of the present invention, reference numeral 21 designates a push-button switch mounted to a metal mounting frame 22. The push-button switch 21 is operated by an operating rod 23. A return coil spring 24 is provided around the operating rod 23 so as to return the push-button switch 21 to a normal or rest position. Reference numeral 25 designates a knob holder formed of synthetic resin. The knob holder 25 has a front opening portion to which a knob 26 is fixed. The knob 26 is formed of a light transmissive resin, and a front surface thereof except appropriate indicating letters or the like is coated with a light transmissive paint. Thus, the knob 26 functions as an indicator through which a light can pass except the indicating letters or the like. Reference numeral 27 designates a slider formed of synthetic resin. The knob holder 25 is mounted to the front end of the slider 27. The slider 27 is formed at its rear end and upper portion with openings 27*b* and 27*c*, and is further formed at its rear end with an upward projection 27*a*. A light transmissive member 28 is fitted in the slider 27. The light transmissive member 28 is formed at its rear end with a downwardly directed oblique surface serving as a light reflecting surface 28*a*. Two light transmissive filters 29 and 30 formed of color films having different colors are attached to the rear end and the upper surface of the light transmissive member 28 at positions corresponding to the openings 27*b* and 27*c* of the slider 27. Reference numeral 31 designates a case formed of synthetic resin. The slider 27 is slidably inserted in the case 31. The case 31 is formed at its rear end and upper portion with first and second openings 31*a* and 31*b* through which the filters 29 and 30 are exposed, respectively.

Figure 4:
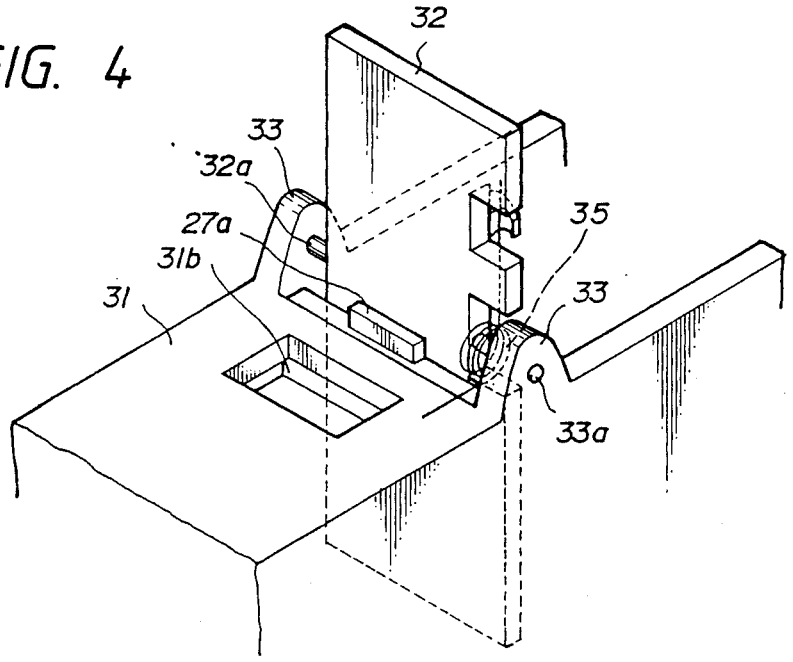
FIG. 4 is an enlarged perspective view of the shutter and the associated parts.
Figure 5A:
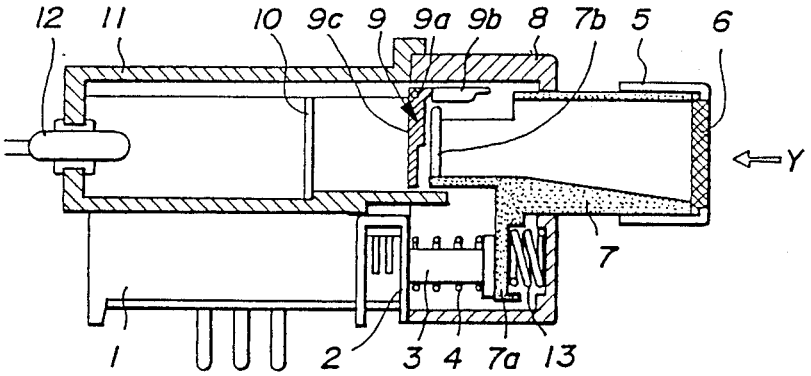
FIG. 5(a) PRIOR ART
FIGS. 5A and 5B are sectional views of the illuminated switch device in the prior art, showing the undepressed condition and the depressed condition of the knob, respectively.
Figure 5B:
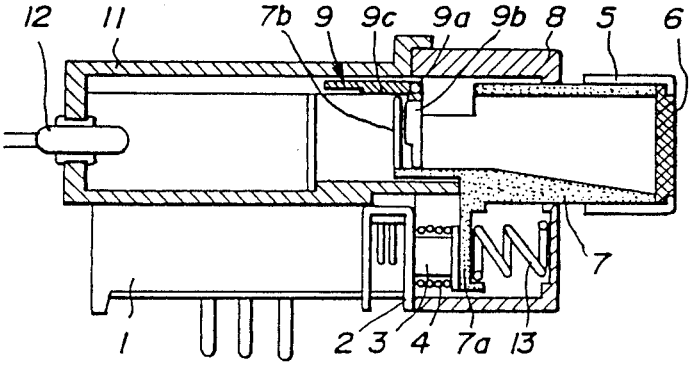
FIG. 5(b) PRIOR ART

As shown in FIG. 4, the case 31 is formed on its upper surface with a pair of bearing projections 33 each having a bearing hole 33*a*. A plate-like shutter 32 is rotatably supported to the bearing projections 33 of the case 31. The shutter 32 is formed of light cutting synthetic resin. The shutter 32 is formed at its substantially central position with a pair of rotating shafts 32*a* inserted in the bearing holes 33*a* of the bearing projections 33. A torsional coil spring 35 is provided around one of the rotating shafts 32*a*, one end portion of the torsional coil spring 35 being engaged with the case 31, while the other end portion being engaged with the shutter 32. Thus, the shutter 32 is normally biased by the elastic force of the torsional coil spring 35 in such a direction as to close the first opening 31*a* of the case 31 (i.e., in the counterclockwise direction as viewed in FIG. 1).

Referring back to FIG. 1, reference numeral 36 designates a light transmissive member mounted in a housing 37. The light transmissive member 36 is formed with a pair of end surfaces 36*a* and 36*b* perpendicular to each other. A lamp 38 as a light source is mounted at an upper portion of the housing 37, so that the light from the lamp 38 is transmitted through the light transmissive member 36, and is projected from the end surfaces 36*a* and 36*b* to the first and second openings 31*a* and 31*b*. A coil spring 34 is interposed between the slider 27 and the case 31, so that the slider 27 may be normally biased to the rest position by the elastic force of the coil spring 34.

The operation of the illuminated switch device as mentioned above will now be described primarily with reference to FIGS. 2 and 3.

Figure 2:
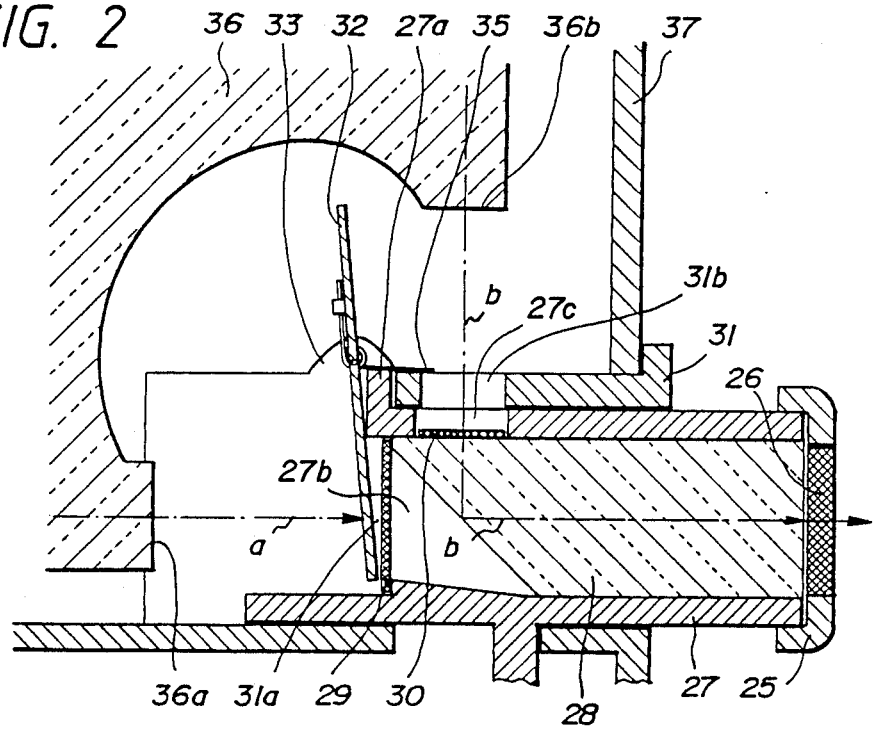
FIG. 2 is an enlarged sectional view of the essential part of the preferred embodiment under the undepressed condition of the knob.

Referring to FIG. 2 which shows a normal or undepressed position of the knob 26, the shutter 32 is biased in the counterclockwise direction by the elastic force of the torsional coil spring 35, and the first opening 31*a* is maintained closed by the shutter 32. Under the condition, the light from the lamp 38 projecting from the end surface 36*a* of the light transmissive member 36 as shown by an arrow a is cut by the shutter 32. On the other hand, the light projecting from the end surface 36*b* as shown by an arrow b is allowed to pass through the second opening 31*b* and the filter 30 and enter the light transmissive member 28. Then, the light is reflected on the light reflecting surface 28*a* to reach the knob 26 and pass therethrough to the outside. Thus, the knob 26 is illuminated in a specific color (e.g., blue-green) synthesized from the colors of the filter 30 and the knob 26.

Figure 3:
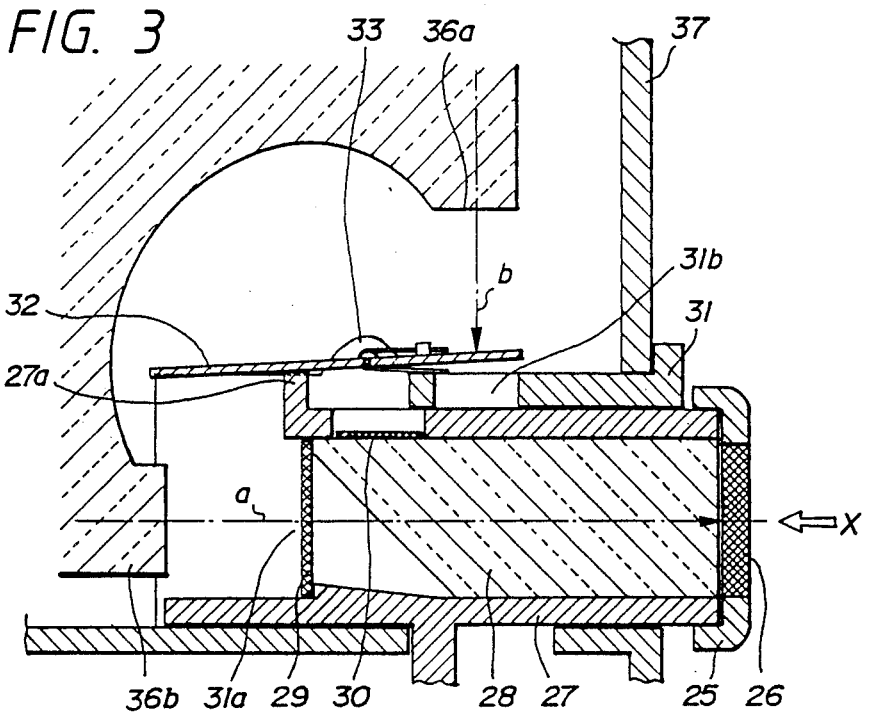
FIG. 3 is a view similar to FIG. 2, showing the depressed condition of the knob.

When the knob 26 is depressed in a direction depicted by an arrow X shown in FIG. 3 to thereby displace the slider 27 in this direction, the shutter 32 is urged by the projection 27*a* of the slider 27 to be rotated in the clockwise direction as viewed in FIG. 3 against the biasing force of the torsional coil spring 35. As a result, the first opening 31*a* is opened, and the second opening 31*b* is instead closed by the shutter 32. Under the condition, the slider 27 is locked in the depressed position by means of a locking mechanism (not shown). The light projecting from the end surface 36*b* of the light transmissive member 36 as shown by the arrow b is cut by the shutter 32. On the other hand, the light projecting from the end surface 36*a* as shown by the arrow a is allowed to pass through the first opening 31*a*, the filter 29, the light transmissive member 28 and the knob 26 to the outside. Thus, the knob 26 is illuminated in a specific color (e.g., amber) synthesized from the colors of the filter 29 and the knob 26.

In the above-mentioned preferred embodiment, the rotating shafts 32*a* of the shutter 32 and the torsional coil spring 35 for elastically biasing the shutter 32 are provided outside of the case 31. Accordingly, these parts can be easily mounted to the case 31. Further, even when the rotational position of the shutter 32 is slightly fluctuated under the depressed or undepressed condition of the knob 26 because of variation in the dimensional accuracy of the parts inclusive of the slider 27, the case 31 and the like, there is no possibility that the transmitted lights from both the filters 29 and 30 will be mixed since either of the light path from the end surface 36*a* of the light transmissive member 36 to the first opening 31*a* or the light path from the end surface 36*b* to the second opening 31*b* is reliably cut. Accordingly, it is possible to prevent the ununiformity of the illumination color of the light passing through the knob 26.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. In an illuminated switch device having a case including a single light source and an operating knob provided with an indicator adapted to be illuminated in different selective colors by a light from said light source; the improvement comprising a light transmissive member fixed to said operating knob, means in said case for slidably mounting said operating knob therein, said operating knob having first and second openings at positions perpendicular to each other, a shutter rotatably supported to said case and adapted to selectively open and close said first and second openings by reciprocation of said operating knob, and transparent color filters having a light transmissivity provided in light paths passing through said first and second openings.

* * * * *